US006875295B2

(12) United States Patent
Blomquist et al.

(10) Patent No.: US 6,875,295 B2
(45) Date of Patent: Apr. 5, 2005

(54) COOL BURNING GAS GENERATING MATERIAL FOR A VEHICLE OCCUPANT PROTECTION APPARATUS

(75) Inventors: Harold R. Blomquist, Gilbert, AZ (US); Abdelkader M. Helmy, Sparks, NV (US); William P. Sampson, Sparks, NV (US); Michael G. Mangum, Mesa, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 10/034,571

(22) Filed: Dec. 27, 2001

(65) Prior Publication Data

US 2003/0145921 A1 Aug. 7, 2003

(51) Int. Cl.[7] ..... C06B 45/10
(52) U.S. Cl. ..... 149/19.7
(58) Field of Search ..... 149/19.7, 45

(56) References Cited

U.S. PATENT DOCUMENTS

| | | | | |
|---|---|---|---|---|
| 3,964,256 A | | 6/1976 | Plantif et al. | |
| 4,293,351 A | | 10/1981 | Johannes | |
| 4,332,631 A | | 6/1982 | Herty, III et al. | |
| 5,542,998 A | | 8/1996 | Bucerius et al. | |
| 5,542,999 A | | 8/1996 | Bucerius et al. | |
| 5,608,183 A | | 3/1997 | Barnes et al. | |
| 5,610,444 A | | 3/1997 | Austruy et al. | |
| 5,731,540 A | | 3/1998 | Flanigan et al. | |
| 5,882,036 A | * | 3/1999 | Moore et al. | 149/45 |
| 5,989,367 A | | 11/1999 | Zeuner et al. | |
| 6,024,811 A | | 2/2000 | Finck et al. | |
| 6,036,894 A | | 3/2000 | Brown et al. | |
| 6,039,820 A | * | 3/2000 | Hinshaw et al. | 149/45 |
| 6,051,158 A | * | 4/2000 | Taylor et al. | 252/67 |
| 6,096,147 A | * | 8/2000 | Taylor et al. | 149/3 |
| 6,129,023 A | | 10/2000 | Marsaud et al. | |
| 6,132,537 A | | 10/2000 | Zeuner et al. | |
| 6,136,112 A | | 10/2000 | Blomquist | |
| 6,143,102 A | | 11/2000 | Mendenhall et al. | |
| 6,156,137 A | * | 12/2000 | Lundstrom et al. | 149/45 |
| 6,156,230 A | | 12/2000 | Wheatley | |
| 6,315,847 B1 | * | 11/2001 | Lee et al. | 149/19.4 |
| 6,334,961 B1 | * | 1/2002 | Wheatley et al. | 149/19.1 |
| 6,352,030 B1 | * | 3/2002 | Doll et al. | 102/291 |
| 6,488,310 B1 | * | 12/2002 | Ryobo et al. | 280/740 |
| 2001/0018812 A1 | * | 9/2001 | Zeuner et al. | 44/551 |

* cited by examiner

*Primary Examiner*—John R. Hardee
(74) *Attorney, Agent, or Firm*—Tarolli, Sundheim, Covell & Tummino L.L.P.

(57) ABSTRACT

A gas generating material (140) for use in a vehicle occupant protection apparatus (10) comprises about 5% to about 20% by weight of the gas generating material, of a binder, 0 to about 50%, by weight of the gas generating material, of an energetic fuel, and an amount of oxidizer effective to oxygen balance the gas generating material. More than 50% by weight of the oxidizer is basic copper nitrate. The binder comprises at least about 20% by volume of the gas generating material.

4 Claims, 3 Drawing Sheets

COOL BURNING GAS GENERATING MATERIAL FOR A VEHICLE OCCUPANT PROTECTION APPARATUS

FIELD OF THE INVENTION

The present invention relates to a gas generating material. The gas generating material is particularly useful for inflating a vehicle occupant protection device.

BACKGROUND OF THE INVENTION

An inflatable vehicle occupant protection device, such as an air bag, is inflated by gas provided by an inflator. The inflator contains a body of ignitable gas generating material. The inflator further includes an igniter. The igniter is actuated so as to ignite the body of gas generating material when the vehicle experiences a collision for which inflation of the air bag is desired. As the body of gas generating material burns, it generates a volume of inflation gas. The inflation gas is directed into the vehicle air bag to inflate the air bag. When the air bag is inflated, it expands into the vehicle occupant compartment and helps to protect the vehicle occupant.

A convenient way of making a gas generating material is by extrusion. A gas generating material that is extruded can be configured into a variety of shapes, including rods, channels, and other structural shapes suitable for use in various types of inflators. Most current gas generating materials that are extruded tend to burn very hot and emit significant amounts of particulate exhaust.

U.S. Pat. No. 5,610,444 discloses a process for continuous manufacture, by kneading and extrusion, of a pyrotechnic charge consisting essentially of a crosslinkable silicone binder and an oxidizing filler. The oxidizing filler comprises ammonium perchlorate and sodium nitrate.

SUMMARY OF THE INVENTION

The present invention is a gas generating material for use in a vehicle occupant protection apparatus. The gas generating material comprises about 5% to about 20% by weight of the gas generating material, of a binder, 0 to about 50%, by weight of the gas generating material, of an energetic fuel, and an amount of oxidizer effective to oxygen balance the gas generating material. More than 50% by weight of the oxidizer is basic copper nitrate. The binder comprises at least about 20% by volume of the gas generating material.

BRIEF DESCRIPTION OF THE DRAWING

Further features of the present invention will become apparent to those skilled in the art to which the present invention relates from reading the following description with reference to the accompanying drawings, in which.

DESCRIPTION OF PREFERRED EMBODIMENT

Figure 1:
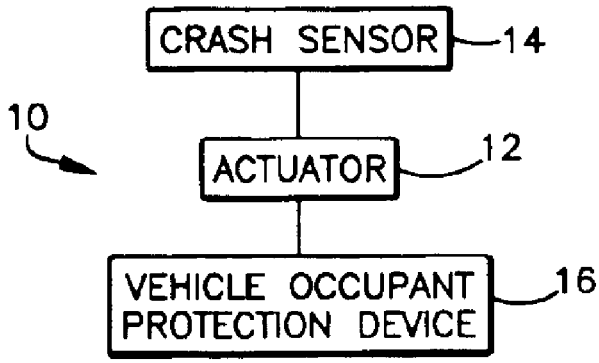
FIG. 1 is a schematic view of a vehicle occupant protection apparatus including an inflator constructed in accordance with the present invention.

As representative of the present invention, FIG. 1 illustrates schematically a vehicle occupant protection apparatus 10. The vehicle occupant protection apparatus 10 includes a vehicle occupant protection device 16. In one embodiment of the present invention, the vehicle occupant protection device 16 is an air bag. The air bag can be a single stage or multi-stage air bag. Other vehicle occupant protection devices that can be used in accordance with the present invention are, for example, an inflatable seat belt, an inflatable knee bolster, an inflatable head liner, an inflatable side curtain, a knee bolster operated by an air bag, and a seat belt actuated by a seat belt pretensioner.

An actuator 12 is associated with the vehicle occupant protection device 16. The actuator 12 is actuatable to generate combustion product that actuates the vehicle occupant protection device 16.

The apparatus 10 also includes a crash sensor 14. The crash sensor 14 is a known device that senses a vehicle condition, such as vehicle deceleration, indicative of a collision or rollover. If the sensed vehicle condition is one for which actuation of vehicle occupant protection device 16 is desired, the crash sensor 14 either transmits a signal or causes a signal to be transmitted to actuator 12. The vehicle occupant protection device 16 is then actuated to help protect a vehicle occupant from a forceful impact with parts of the vehicle.

In one embodiment of the present invention, the actuator is a pyrotechnic inflator for producing an inflation fluid to inflate an air bag. The actuator, however, could be a gas generator for a seat belt pretensioner (not shown), or a hybrid air bag inflator (not shown).

The inflator 12 (FIGS. 2 and 4) includes a generally cylindrical housing 20. The housing 20 has a circular configuration. The housing 20 includes an upper (as viewed in the drawings) housing part 30, referred to herein as a diffuser, and a lower (as viewed in the drawings) housing part 40, referred to herein as a closure.

Figure 2:
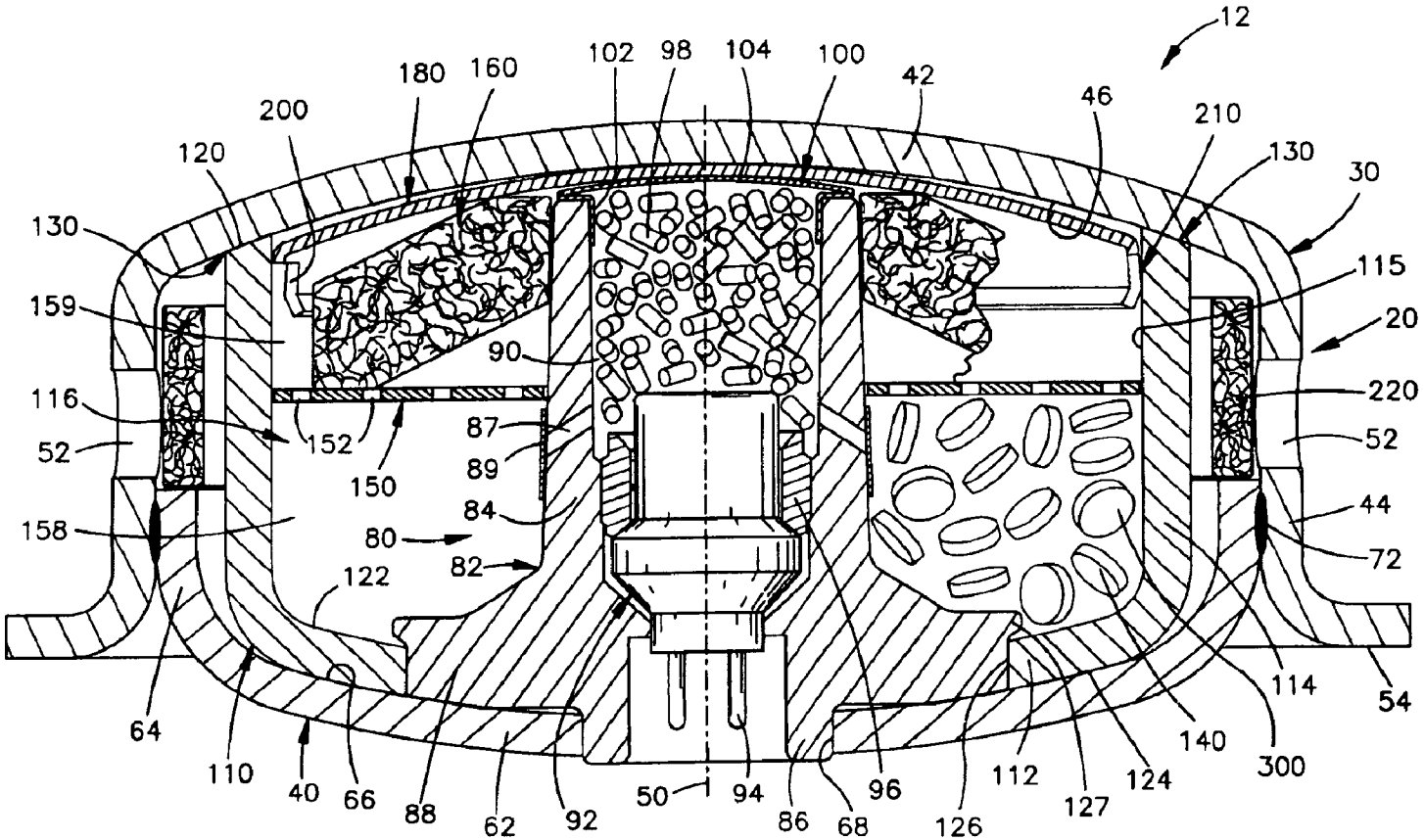
FIG. 2 is an enlarged, sectional view showing the inflator of FIG. 1.

Referring to FIG. 2, the diffuser 30 has an inverted, bowl-shaped configuration including a radially extending bottom wall 42 and an axially extending side wall 44. The bottom wall 42 of the diffuser 30 is domed, that is, has a curved configuration projecting away from the closure 40. The bottom wall 42 has an inner side surface 46.

The side wall 44 of the diffuser 30 has a cylindrical configuration centered on an axis 50 of the inflator 12. A plurality of inflation fluid outlets 52 are disposed in a circular array in the side wall 44. Each one of the inflation fluid outlets 52 extends radially through the side wall 44. The outlets 52 enable flow of inflation fluid out of the inflator 10 to inflate the vehicle occupant protection device 16. The outlets 52, as a group, have a fixed, predetermined flow area. An annular inflator mounting flange 54 extends radially outward from the side wall 44 at a location below (as viewed in FIG. 2) the inflation fluid outlets 52.

The closure 40 has a cup-shaped configuration including a radially extending bottom wall 62 and an axially extending side wall 64. The bottom wall 62 of the closure 40 is domed, that is, has a curved configuration projecting away from the diffuser 30. The bottom wall 62 of the closure 40 has an inner side surface 66 presented toward the bottom wall 42 of the diffuser 30. A circular opening 68 in the bottom wall 62 of the closure 40 is centered on the axis 50 of the inflator 12.

The side wall 64 of the closure 40 has a cylindrical configuration centered on the axis 50. The outer diameter of the side wall 64 of the closure 40 is approximately equal to the inner diameter of the side wall 44 of the diffuser 30. The closure 40 is nested inside the diffuser 30, as seen in FIG. 2, with the side wall of the diffuser overlying the side wall 64 of the closure 40. The side wall 64 of the closure 40 is welded to the side wall 44 of the diffuser 30 with a single, continuous weld 72.

The inflator 10 includes an igniter assembly 80. The igniter assembly 80 includes an igniter housing 82. The igniter housing 82 has a generally tubular configuration including a tapered, axially extending side wall 84, an end portion 86 disposed at the lower end (as viewed in FIG. 2) of the side wall 84, and an annular flange 88 projecting radially from the side wall 84.

The tapered, axially extending side wall 84 of the igniter housing 82 defines an ignition chamber 90 radially inward of the side wall 84. A circular array of passages 87 is formed in the side wall 84. The passages 87 extend between the ignition chamber 90 and the exterior of the igniter housing 82. The radially positioned outer ends of the passages 87 are covered by adhesive foil 89. The end portion 86 of the igniter housing 82 extends into the central opening 68 in the bottom wall 62 of the closure 40.

The igniter assembly 80 includes an initiator 92. The initiator 92 is a known device that is electrically actuatable by an electric current applied through terminals 94 to generate combustion products. A sleeve 96 is press fitted between the initiator 92 and the side wall 84 of the igniter housing 82 to secure the initiator in position in the igniter housing 82.

An ignition material 98 is located in the ignition chamber 90 of the igniter housing 82, adjacent to and in contact with the initiator 92. The ignition material 98 is a known material that is ignitable by the initiator 92 and that, when ignited, generates heat and ignition gas products. Examples of ignition materials are boron potassium nitrate ($BKNO_3$), potassium dinitrobenzofuroxan (KDNBF), barium styphnate (BARSTY), cis-bis-(5-nitroterazolato)pentaamine-cobalt (III)perchlorate (CP), diazidodinitrophenol (DDNP), 1,1-diamino-3,3,5,5-tetraazidotriphosphazine (DATA), cyclotetramethylenetetranitramine (HMX), lead azide, and lead styphnate. Ignition products from combustion of the ignition material 98 flow in a manner to be described from the ignition chamber 90 through passages 87.

The igniter assembly 80 includes a metal igniter cap 100 on the upper end of the igniter housing 82. The igniter cap 100 retains the ignition material 98 in the ignition chamber 90. The igniter cap 100 has an axially extending, cylindrical portion 102, which is press fitted inside the side wall 84 of the igniter housing 82. A radially extending end wall 104 of the igniter cap 100 extends across and closes the ignition chamber 90 in the igniter housing 82.

The flange 88 of the igniter housing 82 extends radially outward from the side wall 84 of the igniter housing. The flange 88 overlies the radially inner portion of the end wall 62 of the closure 40. If desired, a seal (not shown), such as a gasket or a layer of sealant material, may be provided between the flange 88 of the igniter housing 82 and the end wall 62 of the closure 40.

The inflator 12 includes a combustion cup 110. The combustion cup 110 has an annular configuration including a radially extending lower end wall 112 and an axially extending side wall 114. The side wall 114 has an inner side surface 115. A ring-shaped combustion chamber 116 is contained within the combustion cup 110. The radially positioned outer boundary of the combustion chamber 116 is the side wall 114 of the combustion cup 110. The radially positioned inner boundary of the combustion chamber 116 is the side wall 84 of the igniter housing 82.

The side wall 114 of the combustion cup 110 is disposed radially inward of the side walls 44 and 64 of the diffuser 30 and closure 40, respectively. The combustion cup side wall 114 has a ring-shaped upper edge 120. The upper edge 120 has a generally frustoconical configuration, which seats against the inner side surface 46 of the bottom wall 42 of the diffuser 30 so that the combustion cup 110 is essentially closed tight.

The lower end wall 112 of the combustion cup 110 extends radially inward from the lower portion of the side wall 114 of the combustion cup 110. The lower end wall 112 has an inner side surface 122, which is presented toward the diffuser bottom wall 42. The lower end wall 112 has an outer side surface 124, which abuts the inner side surface 66 of the closure bottom wall 62. The axial length of the combustion cup 110 is selected so that the combustion cup is captured axially between the bottom wall 42 of the diffuser 30 and the closure 40.

The lower end wall 112 of the combustion cup 110 has a ring-shaped edge 126. The edge 126 abuts the flange 88 of the igniter housing 82. The flange 88 has an annular ridge 127 which locates the combustion cup 110 axially within the inflator 10, while the flange 88 locates the combustion cup 110 radially within the inflator 12.

The inflator 12 includes an actuatable inflation fluid source 140 in the form of a combustible gas generating material. The gas generating material 140 is located in the combustion chamber 116 in the combustion cup 110. The gas generating material 140 is ignitable by the igniter assembly 80, by the flow of ignition products from the ignition chamber 90 through passages 87. When ignited, the gas generating material 140 produces inflation fluid in the form of gas for inflating the vehicle occupant protection device 16 (FIG. 1).

Figure 3:
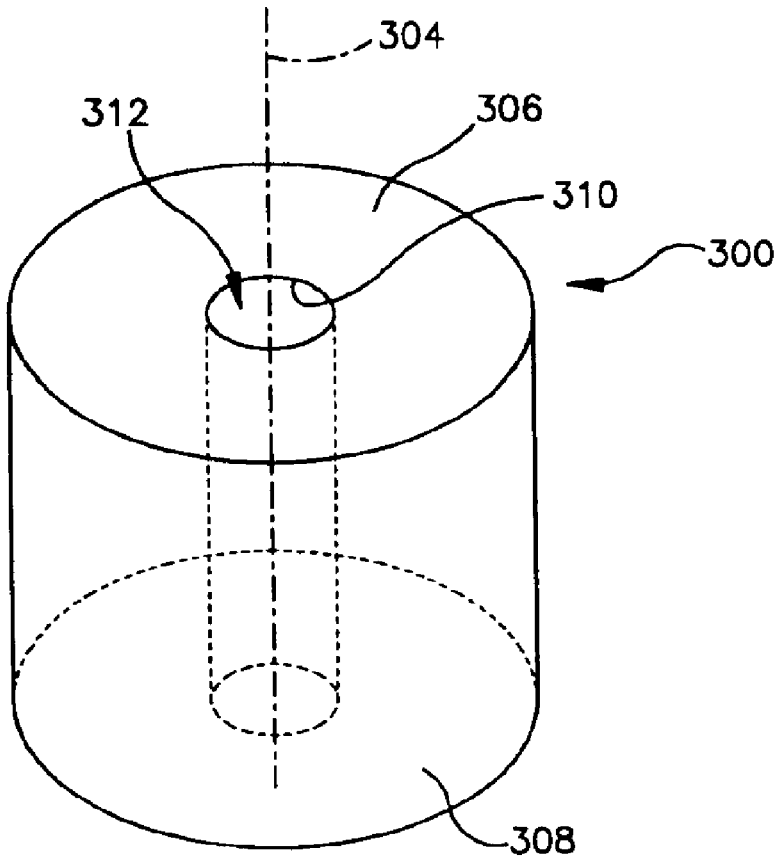
FIG. 3 is an enlarged view of a part of FIG. 2.

The gas generating material 140 is illustrated as being provided in the form of a plurality of randomly oriented bodies 300 of gas generating material. (For clarity in FIG. 2, the gas generating material 140 is not shown in some areas of the combustion chamber 116.) The configuration of a typical body 300 of gas generating material is illustrated in FIG. 3. The body 300 has a cylindrical outer surface centered on axis 304. The body 300 has first and second opposite side surfaces 306 and 308. Each of the opposite side surfaces 306 and 308 has a circular shape centered on the axis 304, and is generally perpendicular to the axis 304.

The outer diameter of the body 300 of gas generating material is about 2 mm to about 3 mm, and preferably, about 2.4 mm. The length of the body 300 is about 1 mm to about 2 mm, and preferably, about 1.5 mm.

The body 300 of gas generating material 140 preferably has a cylindrical inner surface 310, which defines a cylindrical perforation 312 extending along axis 304 through the body 300. The inner diameter of the perforation 312 is about 0.1 mm to about 1 mm, and preferably, about 0.4 mm.

The perforation 312 increases the burn surface area of the body 300 of gas generating material and enhances the flow of combustion products away from the body 300 of gas generating material 140. The body 300 of gas generating material 140 can include other area increasing features such as additional perforations (not shown) or a slot (not shown).

Although the gas generating material 140 has been illustrated as being in the configuration of a plurality randomly oriented cylindrical bodies, it is contemplated that the gas generating material 140 could be provided as a single, multi-perforated disc that encircles the igniter housing 82.

Optionally, it is contemplated that the gas generating material 140 can be positioned in discrete compartments (not shown) in the combustion chamber for multi-level deployment designs.

The inflator 12 further includes a gas generating material retainer 150 in the combustion chamber 116. The retainer 150 is a ring-shaped metal plate having a plurality of perforations 152. The retainer 150 extends radially between the side wall 84 of the igniter housing 82 and the side wall 114 of the combustion cup 110. The retainer 150 divides the combustion chamber 116 into an annular lower section 158 (as viewed in FIG. 2), located between the retainer 150 and the closure 40, and an annular upper section 159 (as viewed in FIG. 2), located between the retainer 150 and the diffuser 30. The gas generating material 140 is retained in the lower section 158.

The inflator 12 includes a combustor heat sink 160 in the combustion chamber upper section 159. The heat sink 160 has an annular configuration extending around side wall 84 of the igniter housing 82. The heat sink 160 is formed as a knitted stainless steel wire tube that is compressed to the frustoconical shape illustrated in the drawings.

The inflator 12 includes a threshold cap 180. The threshold cap 180 is disposed at the top (as viewed in FIG. 2) of the combustion chamber 116 axially between the igniter cap 100 and the diffuser bottom wall 42. The threshold cap 180 is made from stamped sheet metal, preferably aluminum, and is substantially thinner than the diffuser 30 and the closure 40.

The threshold cap 180 has a plurality of openings in the form of slots 200. The slots 200 in the threshold cap 180 together form a fluid flow control passage 210 in the threshold cap. The threshold cap 180, preferably, has six slots 200. A greater or lesser number of slots 200 may be provided to control the flow characteristics of the inflator 12.

The threshold cap 180 (FIG. 2) is disposed in the combustion chamber 116 in the inflator 12, at a location centered on the inflator axis 50. The threshold cap 180 extends across the entire top of the inflator combustion chamber 116. The threshold cap 180 functions to seal the combustion chamber prior to inflator actuation.

In the event of a vehicle collision at or above a predetermined threshold level of collision severity, the inflator 12 is actuated by an electric signal applied to the terminals 94 of the initiator 92. The initiator 92 is actuated and ignites the ignition material 98. The ignition material 98 produces ignition products, which rupture the foil 89 and flow through the passages 87 into the combustion chamber 116. This is indicated by the arrows in FIG. 3. The igniter cap 100, during this time, provides a seal to block flow of the ignition products out of the upper end of the igniter housing 82.

The ignition products flowing into the combustion chamber 116 ignite the gas generating material 140. The gas generating material 140 combusts and produces inflation fluid under pressure in the combustion chamber 116. The pressure in the combustion chamber 116 rises rapidly to an elevated pressure.

The inflation fluid flows out of the combustion chamber 116, through the slots 200 in the threshold cap and toward the fluid passage 130. The heat sink 160 cools and filters the inflation fluid flowing out of the combustion chamber 116. The heat sink 160 also filters particulate matter out of the inflation fluid. The retainer 150 reduces toxic effluent of the combustion process by increasing the completeness of combustion of the gas generating material 140 within the combustion chamber 116. It is believed that this occurs because liquid intermediates from combustion of the gas generating material 140 are prevented from embedding in, and being quenched or extinguished by, the heat sink 160.

Figure 4:
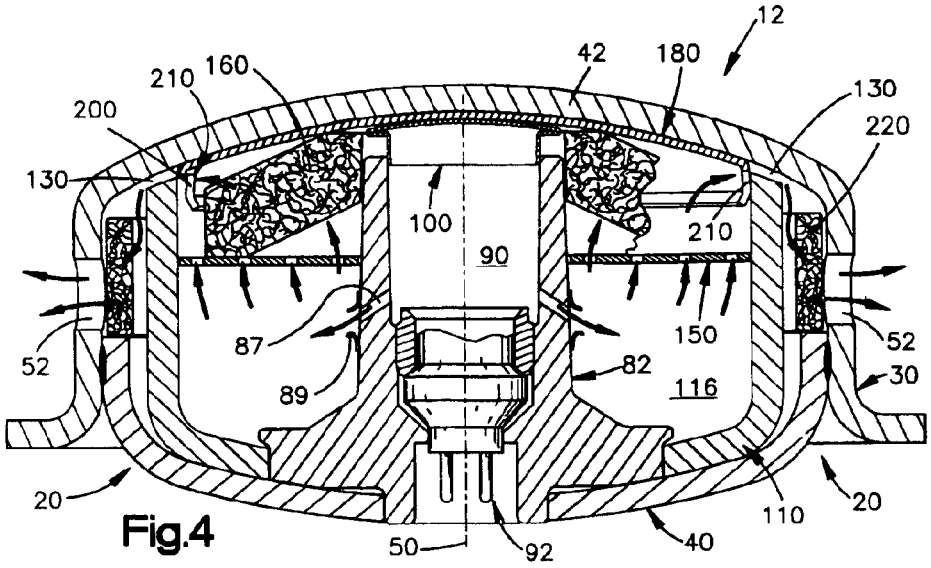
FIG. 4 is a view similar to FIG. 2 showing the inflator in an actuated condition.

Inflation fluid flows through the fluid passage 130, through a final filter 220, and toward the inflation fluid outlets 52, as shown in FIG. 4. The inflation fluid flows out of the combustion chamber 116 along the entire 360° extent of the fluid passage 130. The fluid outlets 52 direct the inflation fluid to flow out of the housing 20 to the inflatable device 16.

In accordance with the present invention, the gas generating material 140 is a solid composite that is manufactured by a dynamic forming technique, such as extrusion. The solid composite gas generating material includes an oxidizer. The oxidizer comprises a first oxidizer that is basic copper nitrate ($Cu(NO_3)_2.3Cu(OH)_2$). Basic copper nitrate is prized for its combination of density, oxygen yield, and gas yield. Moreover, basic copper nitrate produces upon combustion a condensed material that is readily filterable.

The condensed material produced upon combustion of basic copper nitrate includes copper and cuprous oxide. Copper and cuprous oxide readily absorb heat from the combustion process, such that the gas produced upon combustion of these oxidizers has a lower average temperature than from other oxidizers. Copper and cuprous oxide are also readily filtered from the combustion product. Thus, much of the heat produced upon combustion of the basic copper nitrate remains in the inflator 12 and is not conveyed to the vehicle occupant protection device 16.

The amount of basic copper nitrate in the oxidizer is preferably more than about 50% by weight of the oxidizer. The use of more than about 50% by weight of basic copper nitrate in the oxidizer is effective to reduce, substantially, the temperature of the combustion gas produced by combustion of the gas generating material.

The basic copper nitrate is incorporated in the gas generating material in the form of fine particles. The average particle size of the basic copper nitrate is less than about 5 microns. Preferably, the average particle size of the basic copper nitrate is less than about 2 microns.

While basic copper nitrate can be used as the sole oxidizer, the oxidizer preferably includes additional oxidizers. The additional oxidizer can be an oxidizer shown to modify combustion behavior. An example of an additional oxidizer shown to modify combustion behavior is a metal oxide. The inclusion of metal oxides in the gas generating material of the present invention has been found to improve the combustion rate response to changes in pressure. A preferred metal oxide is cupric oxide. Cupric oxide produces, upon combustion, copper and cuprous oxide, which can be readily filtered and which serves to reduce the temperature of the combustion product. Examples of other metal oxides that can be shown to modify combustion behavior and that also produce a filterable combustion material are iron oxide, molybdenum oxide, and titanium oxide, and mixtures thereof.

The amount of metal oxide in the oxidizer is preferably less than about 50% by weight of the oxidizer. More preferably, the ratio of basic copper nitrate to the metal oxide in the oxidizer is from about 1.5:1 to about 3:1. This ratio of basic copper nitrate to metal oxide in the oxidizer is selected to optimize the tradeoff of the volume of gas produced upon combustion of the gas generating material versus the production of undesired gaseous species, such as nitrogen oxides. More preferably, the ratio of basic copper nitrate to the metal oxide is about 2:1.

The metal oxide, like the basic copper nitrate, is incorporated into the gas generating material in the form of fine particles. The average particle size of the metal oxide is preferably less than about 5 microns. More preferably, the average particle size of the metal oxide is about 1 to about 100 nano-meters.

In addition to the basic copper nitrate and the metal oxide, the oxidizer of the gas generating material can also include a small portion of conventional oxidizers based on nitrates, perchlorates, and/or chlorates. Examples of these conventional oxidizers include alkali metal nitrates, alkaline earth metal nitrates, ammonium nitrate, alkali metal perchlorates, alkaline earth metal perchlorates, ammonium perchlorate, alkali metal chlorates, alkaline earth metal chlorates, coordination complexes of these oxidizers, and mixtures thereof. The burn rate of the gas generating material according to the present invention can be controlled over a wide range by manipulating morphology and weight percent of these conventional oxidizers.

The amount of these conventional oxidizers in the oxidizer is up to 30% by weight of the oxidizer. Preferably, the amount of these conventional oxidizers is 0 to about 20% by weight of the oxidizer. The amount of conventional oxidizers in the oxidizer is limited in order to keep as low as possible the combustion temperatures and to limit the amount of difficult-to-condense residues that are produced upon combustion.

A preferred conventional oxidizer is potassium perchlorate. It is known that a high proportion of potassium perchlorate sharply increases the combustion temperature and releases large quantities of potassium chloride, which is present in the form of a gas under combustion conditions. The amount of potassium perchlorate in the oxidizer is limited to up to 20% by weight of the oxidizer because gaseous potassium chloride cannot readily be removed from the combustion product by filters and, after condensation, leads to the undesired formation of smoke in the interior of the vehicle.

The conventional oxidizers are incorporated into the gas generating material in the form of particles. The average particle size of the conventional oxidizers is from about 1 micron to about 100 microns. Preferably, the average particle size of the conventional oxidizers is from about 1 micron to about 20 microns.

The amount of oxidizer in the gas generating material is that amount necessary to oxygen balance the gas generating material so that the gas generating material produces a combustion product essentially free of carbon monoxide. By essentially free of carbon monoxide, it is meant that the amount of carbon monoxide in the combustion gas product is less than about 1% by volume of the gas product, and preferably, less than about 0.05% by volume of the gas product.

The solid composite gas generating material can also include a small amount of an energetic fuel to improve the burn rate and impetus of the gas generating material. By energetic fuel, it is meant a fuel that has a low carbon content and a heat of combustion that can range from low heat of combustion to a high heat of combustion. Preferred energetic fuels include a nitramine, such as cyclotrimethylenetrinitramine or cyclotetramethylenetetranitramine, an organic nitrate, such as guanidine nitrate, triaminoguanidine nitrate, or tetramethyl ammonium nitrate, an amine metal nitrate complex, such as hexamine cobalt (III) nitrate, a nitroorganic, such as nitroguanidine or 3-nitro-1,2,4-triazole-5-one, a blowing agent such as dicyanamide, and mixtures thereof. More preferred energetic fuels are energetic fuels that have a low heat of combustion such as guanidine nitrate, hexamine cobalt (III) nitrate, blowing agents, and mixtures thereof.

The energetic fuel is incorporated into the gas generating material in the form of particles. The average particle size of the energetic fuel is from about 1 micron to about 100 microns. Preferably, the average particle size of the energetic fuel is from about 1 micron to about 50 microns.

The amount of energetic fuel incorporated into the solid composite gas generating material of the present invention is 0 to about 50% by weight of the gas generating material. A preferred amount of energetic fuel incorporated into the solid composite gas generating material is about 25% to about 40% by weight of the gas generating material.

The solid composite gas generating material can further include a sinter forming material. The sinter forming material is a material that when added to and combusted with the solid composite gas generating material of the present invention forms a more cohesive mass of solid combustion products as compared to a similar solid composite gas generating material that does not include such a sinter forming material. Examples of sinter forming materials that can be used in the solid composite gas generating material of the present invention are Group III and Group IV metal oxides such as alumina ($Al_2O_3$) and silica ($SiO_2$).

A preferred sinter forming material is alumina and/or its aqueous hydrates. Alumina is highly viscous at the combustion temperature of the solid composite gas generating material. Alumina readily combines with solid and liquid combustion products to form a cohesive mass of combustion products. Surprisingly, it has been found that when alumina is added to and combusted with the solid composite gas generating material of the present invention, the levels of nitrogen oxides ($NO_x$) in the combustion product are reduced as compared to a similar solid composite gas generating material that does not include alumina.

The amount of sinter forming material incorporated into the solid composite gas generating material of the present invention is 0 to about 30% by weight of the gas generating material. A preferred amount of sinter forming material incorporated into the solid composite gas generating material is about 15% to about 27% by weight of the gas generating material.

The sinter forming material is preferably incorporated into the gas generating material in the form of fine particles. The average particle size of the sinter forming material is about 0.5 microns to about 5 microns. Preferably, the average particle size of the transition metal oxide is about 1 micron to about 2 microns.

Alternatively, in the case where aqueous hydrates of alumina are used, the aqueous hydrates of alumina are incorporated into the gas generating material in the form of a liquid. This liquid provides useful working fluid for extrusion processing.

The solid composite gas generating material also includes a binder that adheres the particles of the oxidizer as well as the particles of energetic fuel and the sinter forming material, if utilized, into a solid mass.

The binder acts as a fuel during combustion and comprises at least about 5% by weight of the fuel in the gas generating material, and preferably, at least about 20% by weight of the fuel in the gas generating material. The amount of binder in the gas generating material is that amount effective, with the energetic fuel, if any, to form an oxygen balanced gas generating material that produces a combustion product essentially free of carbon monoxide. The amount of binder in the gas generating material effective to produce a combustion gas that is essentially free of carbon monoxide is about 5% to about 20% by weight of the gas generating material. A preferred amount of binder is about 7% to about 18% by weight of the gas generating material.

The binder provides the working fluid for processing of the gas generating material by dynamic forming techniques, such as extrusion. The volume of working fluid required to process the gas generating material by dynamic forming techniques is at least about 20% by volume of the gas generating material. Therefore, the volume of binder in the gas generating material is at least about 20% by volume of the gas generating material.

The binder of the present invention can be any binder that, when combined-with the oxidizer, the energetic fuel, and the sinter forming material, if utilized, in an amount effective to form an oxygen balanced gas generating material, provides an effective volume of working fluid to facilitate processing of the gas generating material by dynamic forming techniques.

A preferred binder is a thermosetting binder or a thermoplastic binder that provides the gas generating material strength over a wide range of temperatures. The gas generating material must be neither brittle at a temperature of about −40° C. nor capable of losing its shape or configuration at a temperature of about 110° C.

A preferred thermosetting binder is a silicone binder. A silicone binder comprises cross-linked polysiloxane polymers. The cross-linked polysiloxane polymers are formed from a cross-linkable polysiloxane polymer that has a polymeric backbone of alternating silicon and oxygen atoms with pendant hydrocarbon groups on the silicon atoms. The pendant hydrocarbon groups are predominantly alkyl groups, such as methyl groups, but some of the pendant hydrocarbon groups can be phenyl groups or cyano groups. An example of a cross-linkable polysiloxane polymer that can be used in the silicone binder of the present invention is RTV silicone, which is commercially available from GE Plastics Inc. The cross-linkable polysiloxane is cross-linked by well known cross-linking agents, such as hydropolysiloxane, ethyl silicate, and alkyltrialkoxysilane, to form the cross-linked polysiloxane polymer.

It is preferred to use a silicone binder in the gas generating material of the present invention because the only solid material produced upon combustion of the silicone binder is silica ($SiO_2$). Silica, like the copper and cuprous oxide produced upon combustion of the basic copper nitrate, absorbs heat from the combustion process and is readily filtered so that substantial combustion process heat remains in the inflator 12 and is not conveyed to the vehicle occupant protection device 16. Moreover, when a silicone binder is used in the gas generating material of the present invention, the gas generating material has a burn rate about twice as fast as the burn rate when other binders are used in the gas generating material (i.e., about 2 cm/second at 20 MPa compared to 1 cm/second at 20 MPa).

Another preferred thermosetting binder that can be used in the gas generating material of the present invention is a hydroxy terminated polybutadiene binder cured with isocyanates.

A preferred thermoplastic binder that can be used in the present invention is a mixture of a cellulosic polymer and an N-alkyl-nitratoethyl nitramine plasticizer. Examples of cellulosic polymers that can be used in the binder of the present invention are cellulose acetate butyrate, cellulose acetate propionate, and cellulose acetate. A preferred cellulosic polymer is cellulose acetate butyrate. Examples of N-alkyl-nitratoethyl nitramines that can be used in the binder of the present invention are N-butyl-2-nitratoethyl nitramine and N-propyl-2-nitratoethyl nitramine. A preferred N-alkyl-nitratoethyl nitramine is N-butyl-2-nitratoethylnitramine. The ratio of cellulosic polymer to N-alkyl-nitratoethyl nitramine is about 1:1 to about 2:1. A more preferred ratio of cellulosic polymer to N-alkyl-nitratoethyl nitramine is about 3:2.

Another preferred thermoplastic binder that can be used as the binder in the present invention is a thermoplastic elastomer that comprises a copolymer of bis-3,3-nitratomethyl-oxetane (BNMO) and nitratomethyl-methyl-oxetane (NMMO), as disclosed in U.S. Pat. No. 6,136,112 to Blomquist.

The gas generating material 140 is prepared by adding to a batch mixer the oxidizer, the binder, the energetic fuel, and the sinter forming material, if utilized. A solvent can also be added to the batch mixture to facilitate mixing of the oxidizer, the binder, and energetic fuel. The oxidizer, the binder, and the energetic fuel are mixed until the oxidizer and the energetic fuel are uniformly dispersed in the binder, and a viscous mixture of gas generating material having a dough-like consistency is formed.

The viscous mixture of gas generating material is transferred to a block press. The block press consolidates the viscous mixture of gas generating material into the configuration of a cylindrical rod. The block press could shape the viscous mixture of gas generating material into other configurations, such as rectangular and trapezoidal. The shaped viscous mixture of gas generating material is then exposed to a vacuum that removes entrained gas and any excess solvent remaining in the gas generating material. Following degassing, the shaped viscous mixture of gas generating material is transferred to an extruder, such as a ram extruder, a single screw extruder, or a twin screw extruder.

Alternatively, the oxidizer, the binder, the energetic fuel, the sinter forming material, if utilized, and solvents, if utilized, can be fed through feed ports directly into a single or twin screw extruder. This method is advantageous because this method avoids separate batch steps used for extrusion.

The extruder conducts the gas generating material through a shaping device or die with a predetermined diameter. The extrudate of gas generating material is cut to desired length and cured by evaporation or drying. Optionally, the curing can be enhanced by heating the extrudate of gas generating material. The final shape is that which during combustion delivers the mass flow of gas necessary for the vehicle occupant protection apparatus to function in a timely manner.

The composite gas generating material so formed has a calculated combustion temperature below about 2100 K and a burn rate of at least about 0.5 cm/second at 20 MPa. The composite gas generating material produces upon deflagration, a combustion product that is non-toxic and includes less than about 1% by weight of solid material. Deflagration of the composite gas generating material produces at least about 1.30 moles of gas per 100 grams of gas generating material. The combustion gas is predominantly water vapor, nitrogen, and carbon dioxide.

EXAMPLE 1–13

Examples 1–13 illustrate solid composite gas generating materials prepared in accordance with the present invention.

The compositions, physical/thermochemical properties, and ballistic properties for Examples 1–13 are given in Table 1.

The physical/thermochemical properties listed in Table 1 include the volume % of binder in the gas generating material, the combustion temperature ($T_c$), the exhaust temperature ($T_{ex}$), the combustion impetus ($Impetus_c$) the exhaust impetus ($Impetus_{ex}$), the moles of gas produced per 100 grams, the mole % of $H_2O$, $N_2$, and $CO_2$ in the combustion gas, and the moles of condensed product produced per 100 grams. The physical/thermochemical properties were calculated using the U.S. Navy PEP Thermochemical Equilibrium Code.

The ballistic properties listed in Table 1 include the burn rate at a pressure of 20 MPa ($rb_{20\ Mpa}$), the burn rate at a pressure of 30 MPa ($rb_{30\ Mpa}$), and the pressure exponent at a pressure of 30 MPa (Press. $exp_{30\ Mpa}$). The ballistic properties were calculated using a closed bomb apparatus with a 60 liter tank.

TABLE 1

| | EX 1 | EX 2 | EX 3 | EX 4 | EX 5 | EX 6 | EX 7 |
|---|---|---|---|---|---|---|---|
| Composition | | | | | | | |
| Fuels, wt. % | | | | | | | |
| CAB/BuNena | 0 | 0 | 0 | 0 | 0 | 0 | 0 |
| GUNI | 0 | 0 | 0 | 0 | 0 | 0 | 0 |
| HTPB | 0 | 0 | 0 | 7.31 | 11 | 8.5 | 8.43 |
| Silicone | 12.52 | 13.63 | 14.01 | 0 | 0 | 0 | 0 |
| HACN | 0 | 0 | 0 | 0 | 0 | 0 | 0 |
| Oxidizers, wt. % | | | | | | | |
| $KCLO_4$ | 4.37 | 8.1 | 17.2 | 4.64 | 10 | 15 | 18.2 |
| BCN | 55.5 | 52.29 | 46.96 | 58.82 | 52.66 | 51 | 49.04 |
| CuO | 27.6 | 25.99 | 22.84 | 29.23 | 26.34 | 25.5 | 18.2 |
| Physical/Thermochemical Properties | | | | | | | |
| Vol % Binder | 36 | 37.7 | 37 | 25.4 | 33.7 | 27.3 | 26.73 |
| $T_c$, K. | 1925 | 2003 | 2090 | 1785 | 1802 | 2087 | 2067 |
| $T_{ex}$, K. | 1303 | 1343 | 1421 | 1174 | 1031 | 1358 | 1350 |
| $Impetus_c$, J/g | 235 | 265 | 294 | 238 | 312 | 312 | 320 |
| $Impetus_{Ex}$, J/g | 162 | 176 | 190 | 157 | 171 | 171 | 198 |
| Exhaust Gas | | | | | | | |
| Moles gas/100 grams | 1.33 | 1.34 | 1.41 | 1.41 | 1.8 | 1.51 | 1.55 |
| Mole % $H_2O$ | 65.3 | 64.8 | 64.2 | 53.9 | 34.4 | 52.1 | 51.6 |
| Mole % $N_2$ | 8.9 | 8.1 | 7.2 | 8.8 | 31.3 | 40.5 | 7.1 |
| Mole % $CO_2$ | 25.9 | 27.1 | 28.5 | 37.3 | 6.3 | 7.4 | 41.3 |
| Condensed Product Moles per 100 g of composition | | | | | | | |
| KCl (gas) | 0.025 | 0.046 | 0.100 | 0.007 | 0.003 | 0.030 | 0.078 |
| KCl (liquid) | 0 | 0 | 0 | 0.024 | 0 | 0.068 | 0.030 |
| KCl (solid) | 0 | 0 | 0 | 0 | 0.072 | 0 | 0 |
| Cu (solid) | 0.485 | 0.621 | 0 | 0.509 | 0.770 | 0 | 0 |
| Cu (liquid) | 0 | 0 | 0.401 | 0 | 0 | 0.278 | 0.510 |
| $Cu_2O$ | 0.162 | 0.071 | 0.134 | 0.174 | 0 | 0.078 | 0.102 |
| $SiO_2$ | 0.168 | 0.183 | 0.159 | 0 | 0 | 0 | 0 |
| Ballistic Properties | | | | | | | |
| $rb_{20\ MPa}$, cm/sec, | 2.50 | 2.50 | 2.55 | 0.90 | 1.09 | 1.64 | 1.03 |
| $rb_{30\ MPa}$, cm/sec, | 3.20 | 3.25 | 3.25 | 0.84 | 1.15 | 1.81 | 1.44 |
| Press. $exp_{30\ MPa}$ | 0.6 | 0.6 | 0.6 | 0.2 | 0.2 | 0.6 | 0.6 |

| | EX 8 | EX 9 | EX 10 | EX 11 | EX 12 | EX 13 |
|---|---|---|---|---|---|---|
| Composition | | | | | | |
| Fuels, wt. % | | | | | | |
| CAB/BuNena | 16.4 | 17 | 17.7 | 18.2 | 15 | 15 |
| GUNI | 0 | 0 | 0 | 0 | 10 | 0 |
| HTPB | 0 | 0 | 0 | 0 | 0 | 0 |
| Silicone | 0 | 0 | 0 | 0 | 0 | 0 |
| HACN | 0 | 0 | 0 | 0 | 0 | 10 |
| Oxidizers, wt. % | | | | | | |
| $KCLO_4$ | 4.18 | 8.3 | 12.4 | 16.36 | 15.3 | 15.3 |
| BCN | 53.08 | 49.91 | 46.6 | 43.72 | 39.8 | 39.8 |
| CuO | 26.38 | 24.8 | 23.3 | 21.7 | 19.9 | 19.9 |
| Physical/Thermochemical Properties | | | | | | |
| Vol % Binder | 35.2 | 35.6 | 36.39 | 36.2 | 27.5 | 28.7 |
| $T_c$, K. | 1864 | 1971 | 1999 | 2063 | 2062 | 2024 |
| $T_{ex}$, K. | 1165 | 1236 | 1274 | 1319 | 1253 | 1324 |

TABLE 1-continued

| | | | | | | |
|---|---|---|---|---|---|---|
| Impetus$_c$, J/g | 286 | 311 | 341 | 359 | 403 | 391 |
| Impetus$_{Ex}$, J/g | 179 | 193 | 206 | 216 | 232 | 235 |
| Exhaust Gas | | | | | | |
| Moles gas/100 grams | 1.61 | 1.64 | 1.7 | 1.72 | 1.92 | 1.85 |
| Mole % $H_2O$ | 52.7 | 51.9 | 51.4 | 50.9 | 51.1 | 54.7 |
| Mole % $N_2$ | 9.9 | 9.5 | 8.9 | 8.7 | 15.4 | 14.3 |
| Mole % $CO_2$ | 37.5 | 38.6 | 39.7 | 40.4 | 33.5 | 31.0 |
| Condensed Product Moles per 100 g of composition | | | | | | |
| KCl (gas) | 0.007 | 0.021 | 0.035 | 0.061 | 0.030 | 0.070 |
| KCl (liquid) | 0.020 | 0.033 | 0.035 | 0.038 | 0.071 | 0.019 |
| KCl (solid) | 0 | 0 | 0 | 0 | 0 | 0 |
| Cu (solid) | 0.464 | 0.430 | 0.465 | 0.381 | 0.403 | 0.100 |
| Cu (liquid) | 0 | 0 | 0 | 0 | 0 | 0 |
| $Cu_2O$ | 0.155 | 0.145 | 0.106 | 0.128 | 0.089 | 0.252 |
| $SiO_2$ | 0 | 0 | 0 | 0 | 0 | 0 |
| Ballistic Properties | | | | | | |
| $rb_{20\ MPa}$, cm/sec, | 0.65 | 0.48 | 0.59 | 0.72 | 1.38 | 1.11 |
| $rb_{30\ MPa}$, cm/sec, | 0.51 | 0.57 | 0.74 | 1.05 | 1.94 | 1.53 |
| Press. $exp_{30\ MPa}$ | 0.2 | 0.3 | 0.4 | 0.7 | 0.79 | 0.76 |

Referring to Table 1, Examples 1–3 show solid composite gas generating materials that include an oxidizer and a binder. In each of Examples 1–3, the oxidizer comprises basic copper nitrate (BCN), cupric oxide, and potassium perchlorate, and the binder comprises silicone. In each of Examples 1–3, at least about 50% by weight of the oxidizer is basic copper nitrate, and the ratio of basic copper nitrate to copper oxide is about 2:1. The amount of potassium perchlorate in the oxidizer of Examples 1–3 varies from a minimum of about 5% by weight of the oxidizer (Example 1) to a maximum of about 20% by weight of the oxidizer (Example 3). The gas generating materials of Examples 1–3 are all oxygen balanced to produce a combustion product essentially free of carbon monoxide.

The volume % of binder in each of the gas generating materials of Examples 1–3 is effective to permit extrusion of the gas generating materials. The combustion temperatures for the gas generating materials of Examples 1–3 are all below about 2100 K. The difference between the combustion temperatures and the exhaust temperatures for each Example is at least about 600 K. The amount of condensed residue produced meets criteria for a gas generating material for inflating a vehicle occupant protection device. The amount of gas produced upon combustion, the burn rate, and impetus of the gas generating materials are effective for actuating a vehicle occupant protection device such as an air bag.

Examples 4–7 show solid composite gas generating materials that include an oxidizer and a binder. In each of Examples 4–7, the oxidizer comprises basic copper nitrate, cupric oxide, and potassium perchlorate, and the binder comprises hydroxy terminated polybutadiene (HTPB). In each of the Examples, at least about 50% by weight of the oxidizer is basic copper nitrate, and the ratio of basic copper nitrate to copper oxide is about 2:1. The amount of potassium perchlorate in the oxidizer of Examples 4–7 varies from a minimum of about 5% by weight of the oxidizer (Example 4) to a maximum of about 20% by weight of the oxidizer (Example 7). The gas generating materials in Examples 4–7 are all oxygen balanced to produce a combustion product essentially free of carbon monoxide.

The volume % of binder in each of the gas generating materials of Examples 4–7 is effective to permit extrusion of the gas generating materials. The combustion temperatures for the gas generating materials of Examples 4–7 are all below about 2100 K. The difference between the combustion temperatures and the exhaust temperatures for each Example is at least about 600 K. The amount of condensed residue produced meets criteria for a gas generating material for inflating a vehicle occupant protection device. The amount of gas produced upon combustion, the burn rate, and impetus of the gas generating materials are effective for actuating a vehicle occupant protection device such as an air bag.

Examples 8–11 show solid composite gas generating materials that include an oxidizer and a binder. In each of Examples 8–11, the oxidizer comprises basic copper nitrate, cupric oxide, and potassium perchlorate, and the binder comprises cellulose acetate butyrate and N-butyl-2-nitratoethyl nitramine (CAB/BuNena). In each of Examples 8–11, at least about 50% by weight of the oxidizer is basic copper nitrate, and the ratio of basic copper nitrate to copper oxide is about 2:1. The amount of potassium perchlorate in the oxidizer of Examples 8–11 varies from a minimum of about 5% by weight of the oxidizer (Example 8) to a maximum of about 20% by weight of the oxidizer (Example 11). The gas generating materials in Examples 8–11 are all oxygen balanced to produce a combustion product essentially free of carbon monoxide.

The volume % of binder in each of the gas generating materials of Examples 8–11 is effective to permit extrusion of the gas generating materials. The combustion temperatures for the gas generating materials of Examples 8–11 are all below about 2100 K. The difference between the combustion temperatures and the exhaust temperatures for each Example is at least about 600 K. The amount of condensed residue produced meets criteria for a gas generating material for inflating a vehicle occupant protection device. The amount of gas produced upon combustion, the burn rate, and impetus of the gas generating materials are effective for actuating a vehicle occupant protection device such as an air bag.

Examples 12–13 show solid composite gas generating materials that include an oxidizer, a binder, and an energetic fuel. In each of Examples 1–3, the oxidizer comprises basic copper nitrate, cupric oxide, and potassium perchlorate, and the binder comprises cellulose acetate butyrate and N-butyl-2-nitratoethyl nitramine (CAB/BuNena). The energetic fuel in Example 12 is guanidine nitrate (Guni) and the energetic fuel in Example 13 is hexamine cobalt (III) nitrate (HACN). In each of Examples 12 and 13, at least about 50% by weight of the oxidizer is basic copper nitrate and the ratio of basic copper nitrate to copper oxide is about 2:1. The amount of potassium perchlorate in the oxidizer of Examples 12 and 13 is about 20% by weight of the oxidizer. The gas generating materials in Examples 12 and 13 are oxygen balanced to produce a combustion product essentially free of carbon monoxide.

The volume % of binder in each of the gas generating materials of Examples 12 and 13 is effective to permit extension of the gas generating materials. The combustion temperatures for the gas generating materials of Examples 12 and 13 are below about 2100 K. The difference between the combustion temperatures and the exhaust temperatures for each Example is at least about 600 K. The amount of condensed residue produced meets criteria for a gas generating material for inflating a vehicle occupant protection device. The amount of gas produced upon combustion, the burn rate, and impetus of the gas generating materials are effective for actuating a vehicle occupant protection device such as an air bag.

EXAMPLES 14–18

Examples 14–18 illustrate solid composite gas generating materials prepared in accordance with the present invention. The compositions and thermochemical properties are given in Table 2.

The thermochemical properties listed in Table 2 include the combustion temperature ($T_c$), the exhaust temperature ($T_{ex}$), and the moles of gas produced per 100 grams. The thermochemical properties were calculated using the U.S. Navy PEP Thermochemical Equilibrium Code.

TABLE 2

| | EX 14 | EX 15 | EX 16 | EX 17 | EX 18 |
|---|---|---|---|---|---|
| Composition, wt. % | | | | | |
| HTPB | 7.03 | 7.24 | 7.24 | 7.03 | 7.24 |
| GUNI | 2.34 | 2.41 | 2.41 | 2.34 | 2.41 |
| BCN | 57.51 | 54.32 | 54.32 | 67.51 | 64.32 |
| NaN | 1.90 | 3.79 | 3.79 | 1.90 | 3.79 |
| AP | 2.63 | 5.24 | 5.24 | 2.63 | 5.24 |
| CuO | 28.58 | 27.00 | 0 | 0 | 0 |
| $Al_2O_3$ | 0 | 0 | 27 | 18.58 | 17.00 |
| Thermochemical Properties | | | | | |
| $T_c$, K. | 1811 | 1918 | 1589 | 1723 | 1845 |
| $T_{ex}$, K. | 1193 | 1254 | 1028 | 1089 | 1165 |
| moles of gas/100 g | 1.5 | 1.6 | 1.6 | 1.6 | 1.7 |

Examples 14 and 15 show solid composite gas generating materials that include an oxidizer, a binder, and an energetic fuel. In each of Examples 14 and 15, the oxidizer comprises basic copper nitrate (BCN), cupric oxide (CuO), ammonium perchlorate (AP), and sodium nitrate (NaN), the binder comprises hydroxyterminated polybutadiene (HTPB), and the energetic fuel comprises guanidine nitrate (GUNI). In each of Examples 14 and 15, at least about 50% by weight of the oxidizer is basic copper nitrate and the ratio of basic copper nitrate to copper oxide is about 2:1. The gas generating materials in Examples 14 and 15 are oxygen balanced to produce a combustion product essentially free of carbon monoxide.

The combustion temperatures for the gas generating materials of Examples 14 and 15 are below about 2100 K. The difference between the combustion temperatures and the exhaust temperatures for each Example is at least about 600 K. The amount of gas produced upon combustion of the gas generating materials are effective for actuating a vehicle occupant protection device such as an air bag.

Examples 16–18 show solid composite gas generating materials that include an oxidizer, a binder, an energetic fuel, and a sinter forming material. In each of Examples 16–18, the oxidizer comprises basic copper nitrate (BCN), ammonium perchlorate (AP), and sodium nitrate (NaN), the binder comprises hydroxyterminated polybutadiene (HTPB), the energetic fuel comprises guanidine nitrate (GUNI), and the sinter forming material comprises alumina ($Al_2O_3$). In each of Examples 16–18, at least about 50% by weight of the oxidizer is basic copper nitrate. The gas generating materials in Examples 16–18 are oxygen balanced to produce a combustion product essentially free of carbon monoxide.

The combustion temperatures for the gas generating materials of Examples 16–18 are below about 2100 K. The difference between the combustion temperatures and the exhaust temperatures for each Example is at least about 600 K. The amount of gas produced upon combustion of the gas generating materials are effective for actuating a vehicle occupant protection device such as an air bag.

EXAMPLES 19–27

Examples 19–27 illustrate solid composite gas generating materials prepared in accordance with the present invention. The compositions and physical/thermochemical properties for Examples 19–27 are given in Table 3.

The physical/thermochemical properties listed in Table 3 include, the combustion temperature ($T_c$), the exhaust temperature ($T_{ex}$), the moles of gas produced per 100 grams, the density (g/cc), and the mole % of CO in the exhaust gas. The physical/thermochemical properties were calculated using the U.S. Navy PEP Thermochemical Equilibrium Code.

TABLE 3

| | EX 19 | EX 20 | EX 21 | EX 22 | EX 23 | EX 24 | EX 25 | EX 26 | EX 27 |
|---|---|---|---|---|---|---|---|---|---|
| Composition, wt. % | | | | | | | | | |
| Cab/BuNena | 13.5 | 12 | 13 | 12 | 12 | 13 | 12 | 12 | 12 |
| GUNI | 40 | 6.1 | 0.5 | 12.1 | 7.4 | 7.2 | 11.0 | 15.0 | 5.1 |
| HACN | 0 | 25 | 30 | 25 | 30 | 25 | 15 | 15 | 25 |
| BCN | 36 | 50.9 | 50.5 | 44.9 | 44.6 | 48.8 | 59.0 | 55.0 | 57.9 |
| NaN/AP | 0 | 6 | 6 | 6 | 6 | 6 | 3 | 3 | 0 |
| KP | 0 | 0 | 0 | 0 | 0 | 0 | 0 | 0 | 0 |
| CuO | 0.5 | 0 | 0 | 0 | 0 | 0 | 0 | 0 | 0 |

TABLE 3-continued

| | EX 19 | EX 20 | EX 21 | EX 22 | EX 23 | EX 24 | EX 25 | EX 26 | EX 27 |
|---|---|---|---|---|---|---|---|---|---|
| Physical/Thermochemical Properties | | | | | | | | | |
| $T_c$, K. | 1735 | 2043 | 2054 | 1928 | 1966 | 1976 | 1988 | 1923 | 1964 |
| $T_{ex}$, K. | <1000 | 1008 | 1020 | 914 | 944 | 964 | 986 | 922 | 940 |
| Moles gas/100 g | 3.176 | 2.637 | 2.624 | 2.882 | 2.843 | 2.745 | 2.512 | 2.675 | 2.557 |
| Density g/cc | 1.853 | 2.201 | 2.230 | 2.084 | 2.115 | 2.155 | 2.253 | 2.170 | 2.279 |
| Mole % CO | 10.20 | 0.33 | 0.51 | 2.14 | 1.21 | 1.39 | 0.00 | 1.39 | 0.27 |

Referring to Table 3, Examples 19–27 show solid composite gas generating materials that include an oxidizer, a binder, and an energetic fuel. In each of Examples 19–27, the oxidizer includes basic copper nitrate (BCN). In each of Examples 21–27, the oxidizer also includes a mixture of sodium nitrate (NaN) and ammonium perchlorate (AP). The ratio of sodium nitrate (NaN) to ammonium perchlorate (AP) in the mixture is that ratio effective to yield upon combustion sodium chloride. Additionally, Example 19 includes cupric oxide (CuO). In each of Examples 19–27, the binder comprises a blend of cellulose acetate butyrate and N-butyl-2-nitratoethyl nitramine (CAB/BuNena). The energetic fuel in each of Example 19–28 is guanidine nitrate (GUNI). Each of Examples 22–28 further include hexamine cobalt (III) nitrate (HACN).

The gas generating materials of Examples 19–27 are all oxygen balanced to produce a combustion product essentially free of carbon monoxide.

The combustion temperatures for the gas generating materials of Examples 19–27 are all below about 2000 K. The difference between the combustion temperatures and the exhaust temperatures for each Example is at least about 700 K. The amount of gas produced upon combustion fir each Example is effective for actuating a vehicle occupant protection device such as an air bag.

EXAMPLE 28

A gas generating material comprising cellulose acetate butyrate and N-butyl-2-nitratoethyl nitramine (CAB/BuNena), cupric oxide (CuO), guanidine nitrate (GUNI), basic copper nitrate (BCN), and a mixture of sodium nitrate (NaN) and ammonium perchlorate (AP) was extruded into axially perforated pellets. Each pellet had an outer diameter of 2.4 mm, a inner perforation diameter of 0.4 mm, and a length of 1.5 mm. The gas generating material was oxygen balanced to produce a combustion product essentially free of carbon monoxide.

The weight percentages of the ingredients of the gas generating material are given in Table 4.

TABLE 4

| Ingredient | Wt. % |
|---|---|
| CAB/BuNena | 13.5 |
| GUNI | 34 |
| BCN | 41 |
| NaN/AP | 10 |
| CuO | 0.5 |

About 37 grams of the pellets were tested in conventional ballistic test motor having a sixty liter tank. The tank and combustor pressures were measured and plotted in FIG. 5.

COMPARATIVE EXAMPLE

A conventional gas generating material was prepared by pressing particles of guanidine nitrate (GUNI), ammonium perchlorate (AP), sodium nitrate (NaN), basic copper nitrate (BCN), cupric oxide (CuO), and iron oxide into tablets ($Fe_2O_3$). Each tablet had an outer diameter of about 4 mm and a length of about 1.2 mm. The conventional gas generating material was oxygen balanced to produce a combustion product essentially free of carbon monoxide. The weight percentages of the ingredients of the comparative gas generating are given in Table 5.

TABLE 5

| Ingredient | Wt. % |
|---|---|
| GUNI | 45.8 |
| BCN | 24.6 |
| NaN/AP | 7.16 |
| $Fe_2O_3$ | 9.74 |
| CuO | 12.7 |

About 37 grams of tablets prepared from were tested in conventional ballistic test motor having a sixty liter tank. For comparison to Example 28, the tank and combustor pressures were measured are also plotted in FIG. 5.

Figure 5:
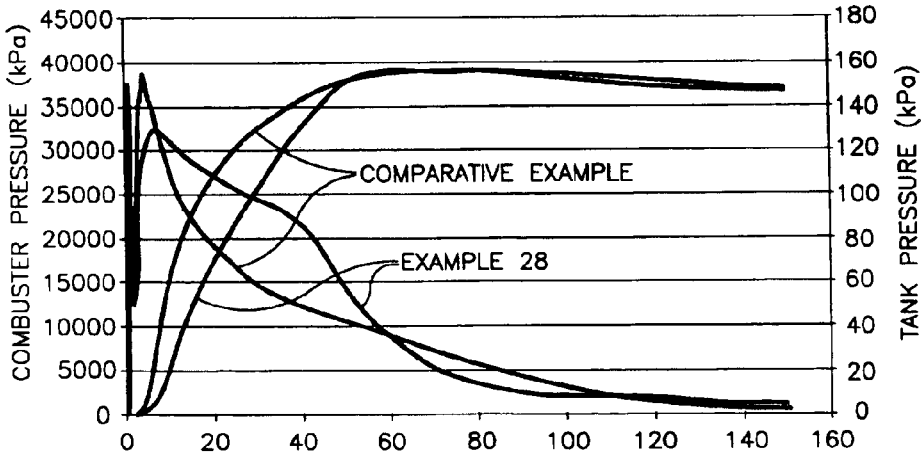
FIG. 5 is a plot showing the combustor pressure and tank pressure versus time from combustion of a gas generating material in accordance with the present invention and a prior art gas generating material.

FIG. 5 shows that the average slope of the tank pressure plot, during the first 20 milliseconds, for the gas generating material of Example 28 (i.e., a slope of about 5.5 kPa/ms) was substantially lower (i.e., less steep) than the average slope of the tank pressure plot for the conventional gas generating material of the comparative example (i.e., a slope of about 3.5 kPa/ms). The substantially lower slope indicates that the gas generating material of Example 28 generated less force in the first 20 milliseconds compared to the conventional gas generating material of the comparative example. The generation of less force in the first 20 milliseconds is advantageous because it allows the air bag to be deployed with less force.

Both the tank pressure of the gas generating material of Example 28 and tank pressure of the conventional gas generating material reach about 95% their peak pressures after 40 milliseconds. This indicates that the gas generating material of Example 28 can fill an air bag to peak pressure in essentially the same amount of time as the conventional gas generating material of the comparative example.

From the above description of the invention, those skilled in the art will perceive improvements, changes and modifications. Such improvements, changes and modifications within the skill of the art are intended to be covered by the appended claims.

Having described the invention the following is claimed:

1. An extruded solid composite gas generating material for use in a vehicle occupant protection apparatus comprising:

about 5% to about 20% by weight of the gas generating material, of a mixture of cellulose acetate butyrate and butyl nitratoethylnitramine 0 to about 50%, by weight of the gas generating material, of an energetic fuel with a low heat of heat of combustion; and an amount of oxidizer effective to oxygen balance the gas generating material;

wherein more than 50% by weight of the oxidizer is basic copper nitrate.

2. The gas generating material of claim 1 wherein the energetic fuel comprises guanidine nitrate, hexamine cobalt (III) nitrate, or mixtures thereof.

3. The gas generating material of claim 2 wherein the energetic fuel comprises about 20% to about 40% by weight of the gas generating material.

4. The gas generating material of claim 3 wherein the oxidizer further comprises a mixture of sodium nitrate and ammonium perchlorate.

* * * * *